US010881214B2

(12) United States Patent
Chung

(10) Patent No.: US 10,881,214 B2
(45) Date of Patent: Jan. 5, 2021

(54) MODULAR BED

(71) Applicant: ULIFE HEALTHCARE INC., Taoyuan (TW)

(72) Inventor: Ya-Hsin Chung, Taichung (TW)

(73) Assignee: ULIFE HEALTHCARE INC., Taoyuan (TW)

( * ) Notice: Subject to any disclaimer, the term of this patent is extended or adjusted under 35 U.S.C. 154(b) by 304 days.

(21) Appl. No.: 15/985,465

(22) Filed: May 21, 2018

(65) Prior Publication Data

US 2019/0239652 A1 Aug. 8, 2019

(30) Foreign Application Priority Data

Feb. 2, 2018 (TW) ..... 107201666 U

(51) Int. Cl.

| | |
|---|---|
| ***A47C 19/02*** | (2006.01) |
| ***A47C 23/02*** | (2006.01) |
| ***A47C 20/04*** | (2006.01) |
| ***A47C 17/86*** | (2006.01) |
| ***A47C 17/58*** | (2006.01) |

(52) U.S. Cl.

CPC ..... *A47C 19/025* (2013.01); *A47C 20/041* (2013.01); *A47C 23/02* (2013.01); *A47C 17/58* (2013.01); *A47C 17/86* (2013.01)

(58) Field of Classification Search

CPC ..... A47C 17/58; A47C 17/86; A47C 19/025; A47C 20/041; A47C 23/02

See application file for complete search history.

(56) References Cited

U.S. PATENT DOCUMENTS

| | | | | |
|---|---|---|---|---|
| 1,666,754 | A * | 4/1928 | Rahe | B60R 19/285 293/135 |
| 2,115,400 | A * | 4/1938 | Schlappritzi | A47C 23/30 5/247 |
| 3,101,487 | A * | 8/1963 | Isaacs | A47C 7/285 5/254 |
| 6,752,458 | B1 * | 6/2004 | Rivera | A47C 3/021 267/158 |
| 9,839,295 | B2 * | 12/2017 | Robinson | A47C 5/12 |
| 10,399,469 | B2 * | 9/2019 | Won | B60N 2/80 |
| 2010/0122415 | A1 * | 5/2010 | Turner | A61G 7/018 5/618 |
| 2017/0347807 | A1 * | 12/2017 | Totemeier | A47C 19/005 |
| 2018/0103768 | A1 * | 4/2018 | Nava | A47C 19/02 |
| 2018/0125249 | A1 * | 5/2018 | Chung | A47C 19/021 |

* cited by examiner

*Primary Examiner* — David R Hare
*Assistant Examiner* — Alexis Felix Lopez
(74) *Attorney, Agent, or Firm* — TraskBritt

(57) ABSTRACT

A modular bed includes a base frame unit and a plurality of support frame units mounted on the base frame unit to be displaced from each other. Each of the support frame units has a lead bar, a trailing bar, four mounting frames, a support panel, and four bent leaf springs each coupling the support panel to a respective one of the mounting frames so as to provide cushioning effect for the support panel in response to movement of the support panel from an unloaded position to a loaded position.

4 Claims, 8 Drawing Sheets

MODULAR BED

CROSS-REFERENCE TO RELATED APPLICATION

This application claims priority from Taiwanese utility model Utility Model Application No. 107201666, filed on Feb. 2, 2018.

TECHNICAL FIELD

The disclosure relates to a modular bed, and, more particularly to a modular bed with cushioning effect.

BACKGROUND

Conventionally, it is a mattress that provides cushioning effect. A conventional bed base or modular bed for supporting the mattress is normally made from stiff material, and thus is less likely to provide such cushioning effect.

BRIEF SUMMARY

Therefore, an object of the disclosure is to provide a modular bed with cushioning effect.

According to a first aspect of the disclosure, the modular bed includes a base frame unit, and a plurality of support frame units mounted on the base frame unit to be displaced from each other in a longitudinal direction. Each of the support frame units includes a leading bar, a trailing bar, four mounting frames, a support panel, and four bent leaf springs. The leading and trailing bars are displaced from each other in the longitudinal direction. Each of the leading and trailing bars has a left end segment and a right end segment opposite to the left end segment in a transverse direction relative to the longitudinal direction. Each of the mounting frames extends upwardly from a respective one of the left and right end segments of the leading and trailing bars. The support panel is configured to conceal the mounting frames from view and is disposed to be movable relative to the mounting frames between a loaded position and an unloaded position. Each of the bent leaf springs has a secured segment, a fixed segment, an upper curved segment, and a lower curved segment. The secured segment has a first mounting region secured to a respective one of the mounting frames, and a suspended region extending lengthwise from the first mounting region to terminate at a lower juncture. The fixed segment has a second mounting region fixed to a lower surface of the support panel, and an extension region extending lengthwise from the second mounting region to terminate at an upper juncture, which is offset from the lower juncture by a predetermined length. The upper curved segment extends from the upper juncture in a circumferential direction to terminate at a deflection area. The lower curved segment extends from the lower juncture in a circumferential direction to join the deflection area to permit the upper and lower curved segments to produce a combined biasing force so as to provide cushioning effect for the support panel in response to movement of the support panel from the unloaded position to the loaded position.

According to a second aspect of the disclosure, the modular bed includes a base frame unit, a plurality of support frame units, and a driving unit. The support frame units are mounted on the base frame unit to be displaced from each other in a longitudinal direction. At least one of the support frame units is pivotally mounted to the base frame unit. Each of the support frame units includes a leading bar, a trailing bar, four mounting frames, a support panel, and four spring members. The leading and trailing bars are displaced from each other in the longitudinal direction. Each of the leading and trailing bars has a left end segment and a right end segment opposite to the left end segment in a transverse direction relative to the longitudinal direction. Each of the four mounting frames extends upwardly from a respective one of the left and right end segments of the leading and trailing bars. The support panel is configured to conceal the mounting frames from view and is disposed to be moveable relative to the mounting frames between a loaded position and an unloaded position. Each of the spring members is configured to couple the support panel to a respective one of the mounting frames so as to provide cushioning effect for the support panel in response to movement of the support panel from the unloaded position to the loaded position. The drive unit is coupled between the base frame unit and the at least one of the support frame units so as to permit one of the leading and trailing bars of the at least one of the support frame units to be driven to move to an elevated position, where the one of the leading and trailing bars is remote from the ground, from a normal position, where the one of the leading and trailing bars is close to the ground.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
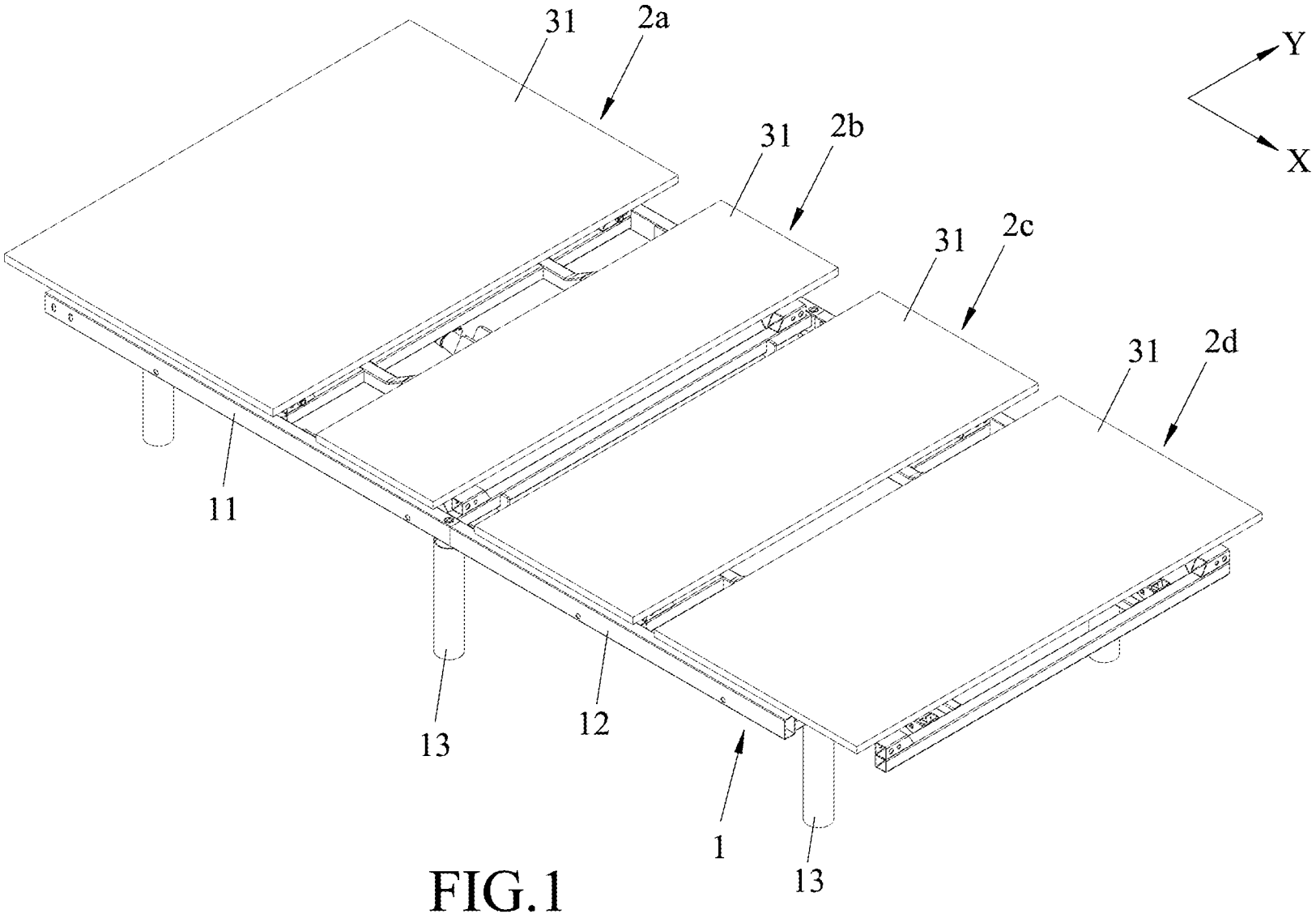
FIG. 1 is a perspective view of a modular bed according to an embodiment of the disclosure.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Referring to FIGS. 1 to 4, a modular bed is shown to include a base frame unit 1, and a plurality of support frame units 2*a*, 2*b*, 2*c*, 2*d* mounted on the base frame unit 1 to be displaced from each other in a longitudinal direction (X). Each of the support frame units 2*a*, 2*b*, 2*c*, 2*d* includes a leading bar 21, a trailing bar 22, four mounting frames 23, a support panel 31, and four spring members 32.

The leading and trailing bars 21, 22 are displaced from each other in the longitudinal direction (X). Each of the leading and trailing bars 21, 22 has a left end segment 201 and a right end segment 202 opposite to the left end segment 201 in a transverse direction (Y) relative to the longitudinal direction (X).

Each of the mounting frames 23 extends upwardly from a respective one of the left and right end segments 201, 202 of the leading and trailing bars 21, 22.

Figure 8:
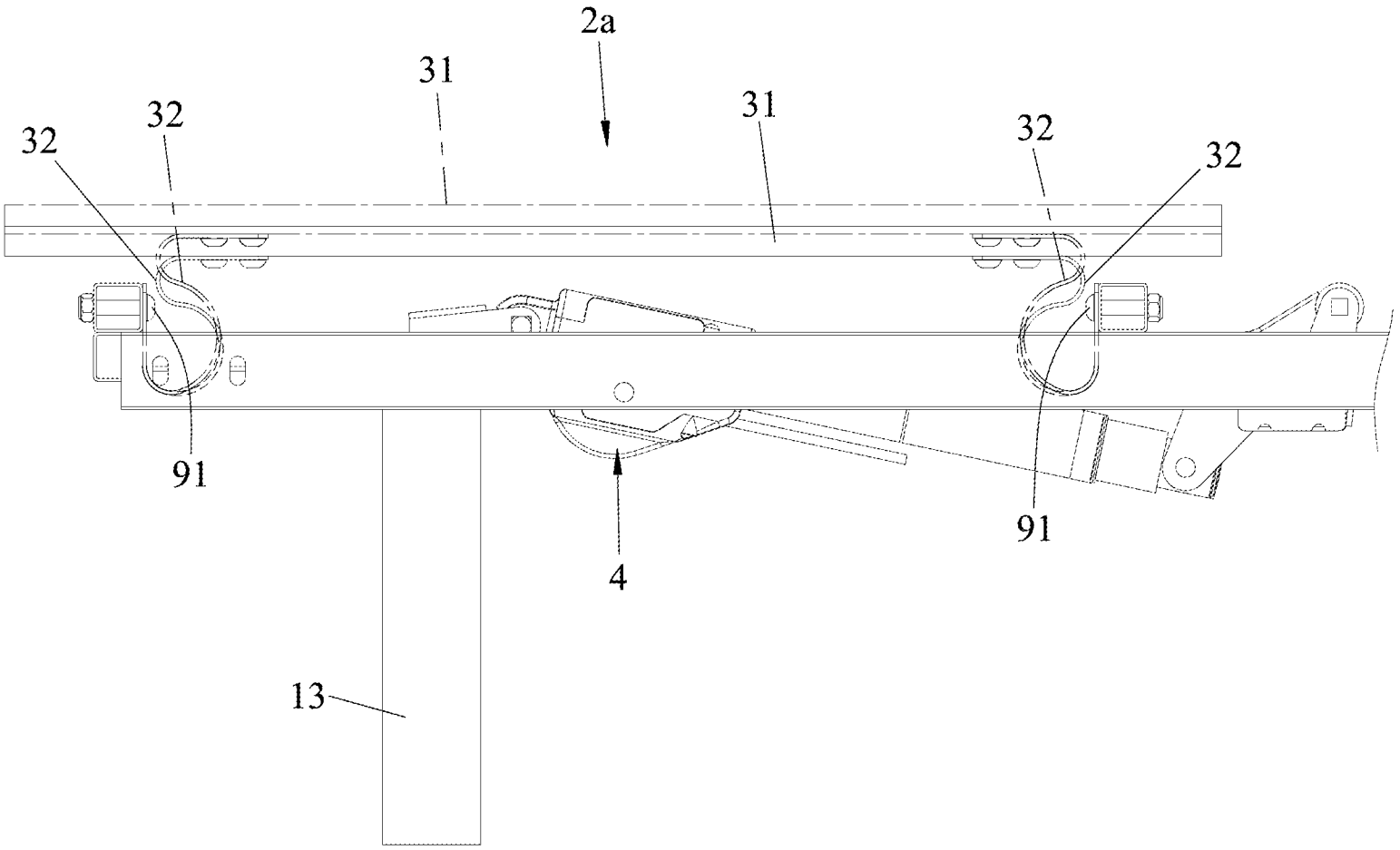
FIG. 8 is a fragmentary enlarged side view of the modular bed in which a support panel in a loaded position is shown by solid lines, and the support panel in an unloaded position is shown by image lines.

The support panel 31 is configured to conceal the mounting frames 23 from view and is disposed to be moveable relative to the mounting frames 23 between a loaded position and an unloaded position. As shown in FIG. 8, the support panel 31 in the loaded position is shown by solid lines, and the support panel 31 in the unloaded position is shown by image lines. The support panel 31 may be made from wood, plywood, plastic, etc.

Each of the spring members 32 is a bent leaf spring for coupling the support panel 31 to a respective one of the mounting frames 23, and includes a secured segment 34, a fixed segment 33, an upper curved segment 35, and a lower curved segment 36. In an embodiment shown in FIGS. 4 and 5, the bent leaf spring 32 is made by bending a metal strip into an S-shape.

The secured segment 34 has a first mounting region 340 and a suspended region 342. The first mounting region 340 is secured to a respective one of the mounting frames 23. The suspended region 342 extends lengthwise from the first mounting region 340 to terminate at a lower juncture 343. In an embodiment shown in FIG. 4, the first mounting region 340 has a through bore 341 configured to permit the first mounting region 340 to be detachably secured to the respective mounting frame 23 by virtue of a fastener 91 (see also FIG. 8).

The fixed segment 33 has a second mounting region 330 and an extension region 332. The second mounting region 330 is fixed to a lower surface of the support panel 31. The extension region 332 extends lengthwise from the second mounting region 330 to terminate at an upper juncture 333 which is offset from the lower juncture 343 by a predetermined length (L) (see FIG. 5). In an embodiment shown in FIG. 4, the second mounting region 330 has two through holes 331 configured to permit the second mounting regions 330 to be detachably fixed to the support panel 31 by virtue of two fasteners 92 (see also FIG. 2).

The upper curved segment 35 extends from the upper juncture 333 in a circumferential direction to terminate at a deflection area 351. In an embodiment shown in FIGS. 4 and 5, the upper curved segment 35 defines a radius of curvature smaller than the predetermined length (L).

The lower curved segment 36 extends from the lower juncture 343 in a circumferential direction to join the deflection area 351 to permit the upper and lower curved segments 35, 36 to produce a combined biasing force so as to provide cushioning effect for the support panel 31 in response to movement of the support panel 31 from the unloaded position to the loaded position (see FIG. 8).

Figure 4:
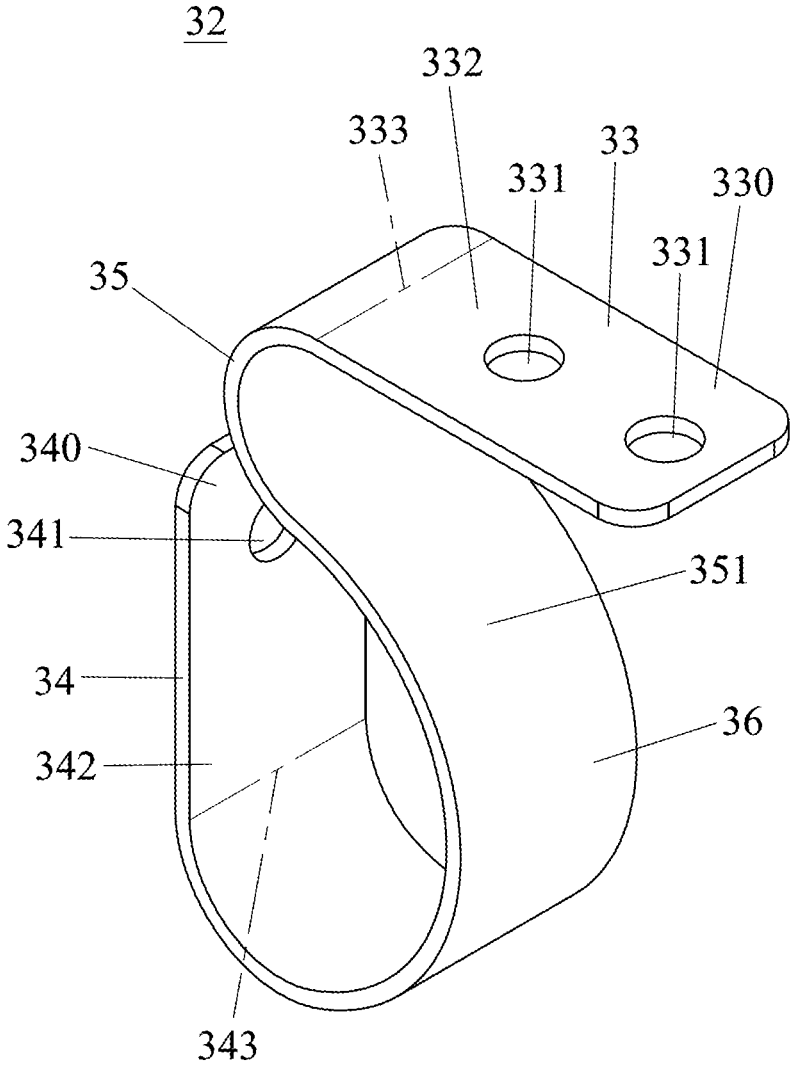
FIG. 4 is an enlarged perspective view of a bent leaf spring used for the modular bed.
Figure 5:
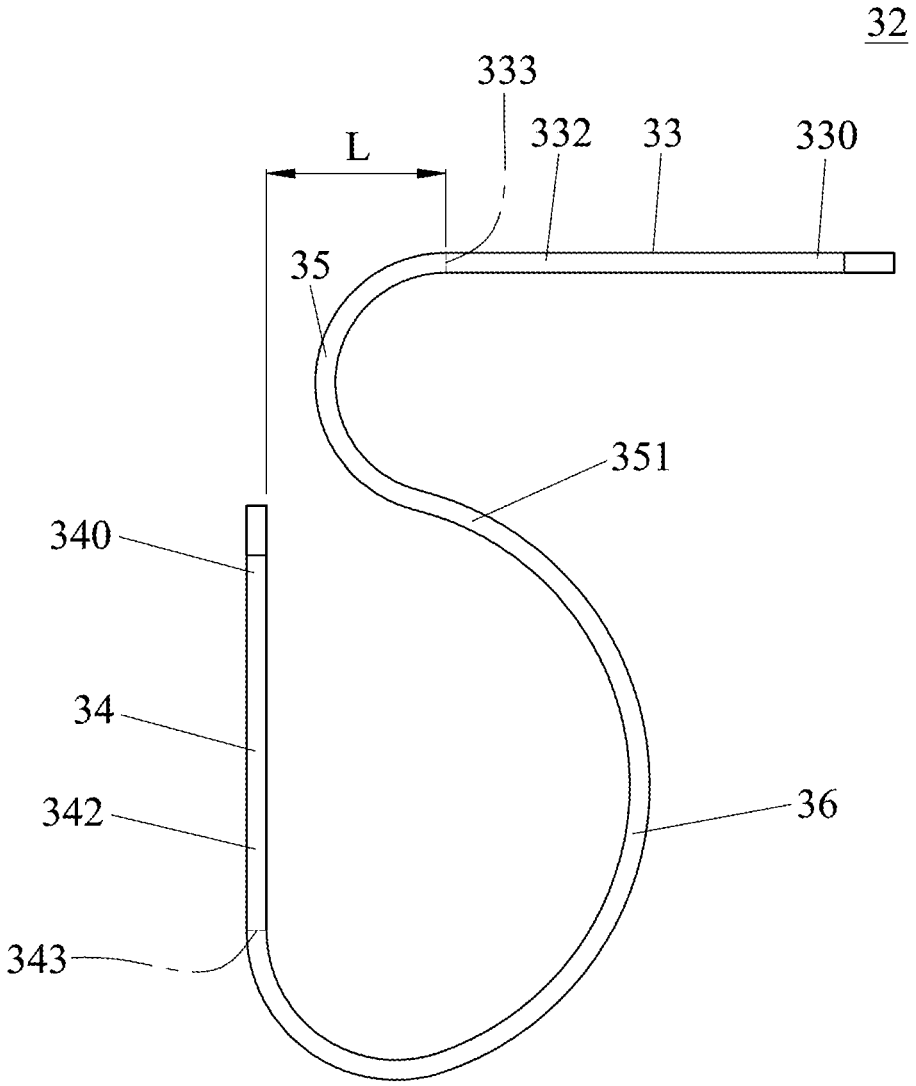
FIG. 5 is a side view of the bent leaf spring used for the modular bed FIG. 4.

In an embodiment shown in FIGS. 4 and 5, the lower curved segment 36 defines a radius of curvature larger than the predetermined length (L) so as to increase the combined biasing force.

Figure 3:
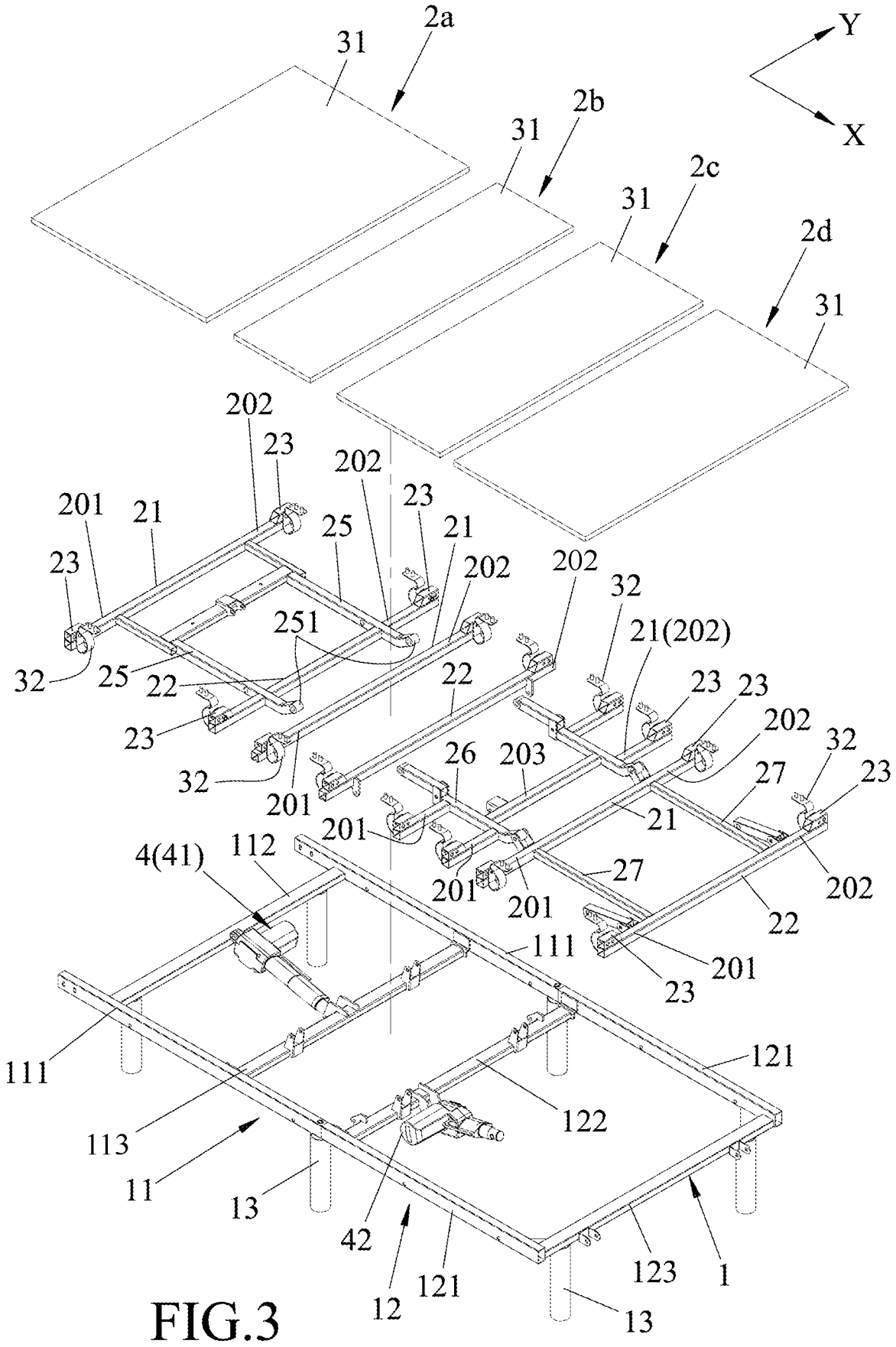
FIG. 3 is an exploded perspective view of the modular bed of FIG. 1.

In an embodiment shown in FIG. 3, the base frame unit 1 has a front base frame 11 and a rear base frame 12. The rear base frame 12 is coupled to and aligned with the front base frame 11 in the longitudinal direction (X) to permit the front and rear base frames 11, 12 to be arranged in a head-to-tail arrangement.

The front base frame 11 includes two front beams 111, a first front transverse beam 112, and a second front transverse beam 113, and the rear base frame 12 includes two rear beams 121, a first rear transverse beam 122, and a second rear transverse beam 123. Each of the front beams 111, the first and second front transverse beams 112, 113, the rear beams 121, and the first and second rear transverse beams 122, 123 may be a square, hollow metal tube which is of lightweight and high strength. The elements for the base frame unit 1 may be easily assembled or disassembled.

Figure 6:
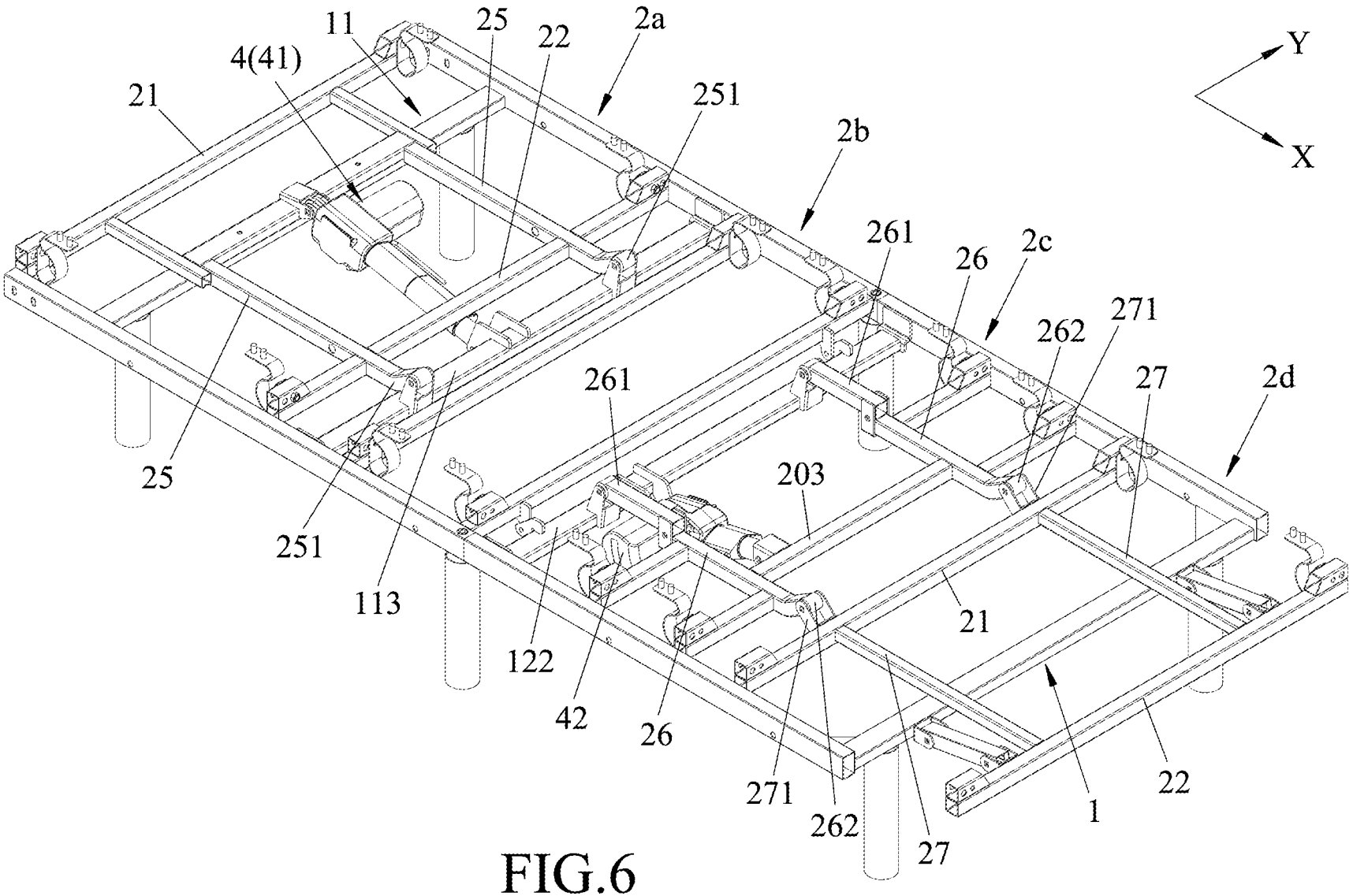
FIG. 6 is a perspective view of the modular bed, in which support panels are omitted.

In an embodiment shown in FIGS. 3 and 6, the modular bed includes four of the support frame units 2*a*, 2*b*, 2*c*, 2*d*. A first one of the support frame units is a first front support frame unit 2*a*, a second one of the support frame units is a second front support frame unit 2*b*, a third one of the support frame units is a first rear support frame unit 2*c*, and a fourth one of the support frame units is a second rear support frame unit 2*d*.

Figure 7:
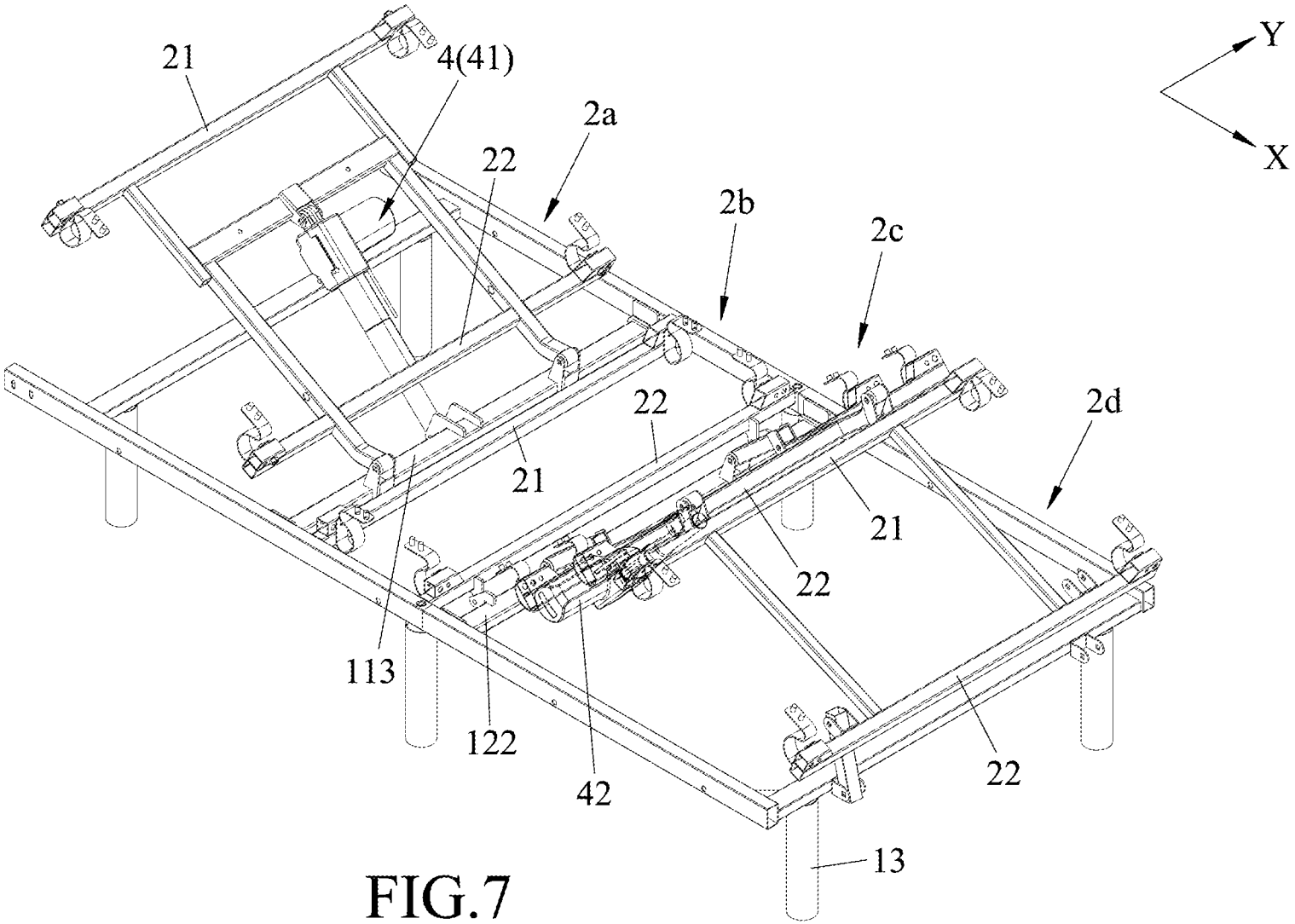
FIG. 7 is similar to FIG. 6 but illustrates the modular bed in another state.

As shown in FIGS. 3 and 6, the first front support frame unit 2*a* is mounted on the front base frame 11, and further includes a pair of head support links 25 each extending from the leading bar 21 through the trailing bar 22 to terminate at a pivot end 251 which is mounted pivotally on the second front transverse beam 113 so as to permit leading bar 21 of the first front support frame unit 2*a* to be lifted from a head normal position (FIG. 6), where the leading bar 21 is close to the ground, to a head elevated position (FIG. 7), where the leading bar 21 is remote from the ground.

The second front support frame unit 2*b* is mounted on the front base frame 11, and is disposed rearwardly of the first front support frame unit 2*a*. In addition, the leading and trailing bars 21, 22 of the second front support frame unit 2*b* are secured on the front beams 111.

The first rear support frame unit 2*c* is mounted on the rear base frame 12, and further includes a pair of front leg links 26 and a middle bar 203 (see FIG. 6). The middle bar 203 interconnects the front leg links 26 for connecting the left and right end segments 201, 202 of each of the leading and trailing bars 21, 22. Each of the front leg links 26 has a first forward pivot end segment 261 and a first rearward pivot end 262. The first forward pivot end segment 261 is mounted pivotally on the first rear transverse beam 122 so as to permit the middle bar 203 to be lifted from a leg normal position (FIG. 6) where the middle bar 203 is close to the ground, to a leg elevated position (FIG. 7), where the middle bar 203 is remote from the ground.

The second rear support frame unit 2*d* is mounted on the rear base frame 12, and is disposed rearwardly of the first rear support frame unit 2*c*. The second rear support frame unit 2*d* further includes a pair of rear leg support links 27 each extending from the trailing bar 22 through the leading bar 21 to terminate at a second forward pivot end 271. The second forward pivot end 271 is pivotally connected to the first rearward pivot end 262 of a respective one of the front leg links 26 so as to permit the leading bar 21 of the second rear support frame unit 2*d* to be lifted when the middle bar 203 is lifted to the leg elevated position.

Each of the bars, the links, and the mounting frames of the support frame units 2*a*, 2*b*, 2*c*, 2*d* may be a square, hollow metal tube of lightweight and high strength, or may be constituted by a plurality of square, hollow metal tube segments of lightweight and high strength. The elements for the support frame units 2*a*, 2*b*, 2*c*, 2*d* may be easily assembled or disassembled.

In an embodiment shown in FIGS. 2, 3, 6, and 7, the modular bed further includes a drive unit 4 which includes a front jack member 41 and a rear jack member 42. The front and rear jack members 41, 42 can be operated independently.

The front jack member 41 is coupled between the front base frame 11 and the first front support frame unit 2*a* so as to permit the leading bar 21 of the first front support frame unit 2*a* to be driven by the front jack member 41 to move between the head normal position and the head elevated position.

The rear jack member 42 is coupled between the rear base frame 12 and the first rear support frame unit 2*c* so as to permit the middle bar 203 of the first rear support frame unit 2*c* to be driven by the rear jack member 42 to move between the leg normal position and the leg elevated position.

Figure 2:
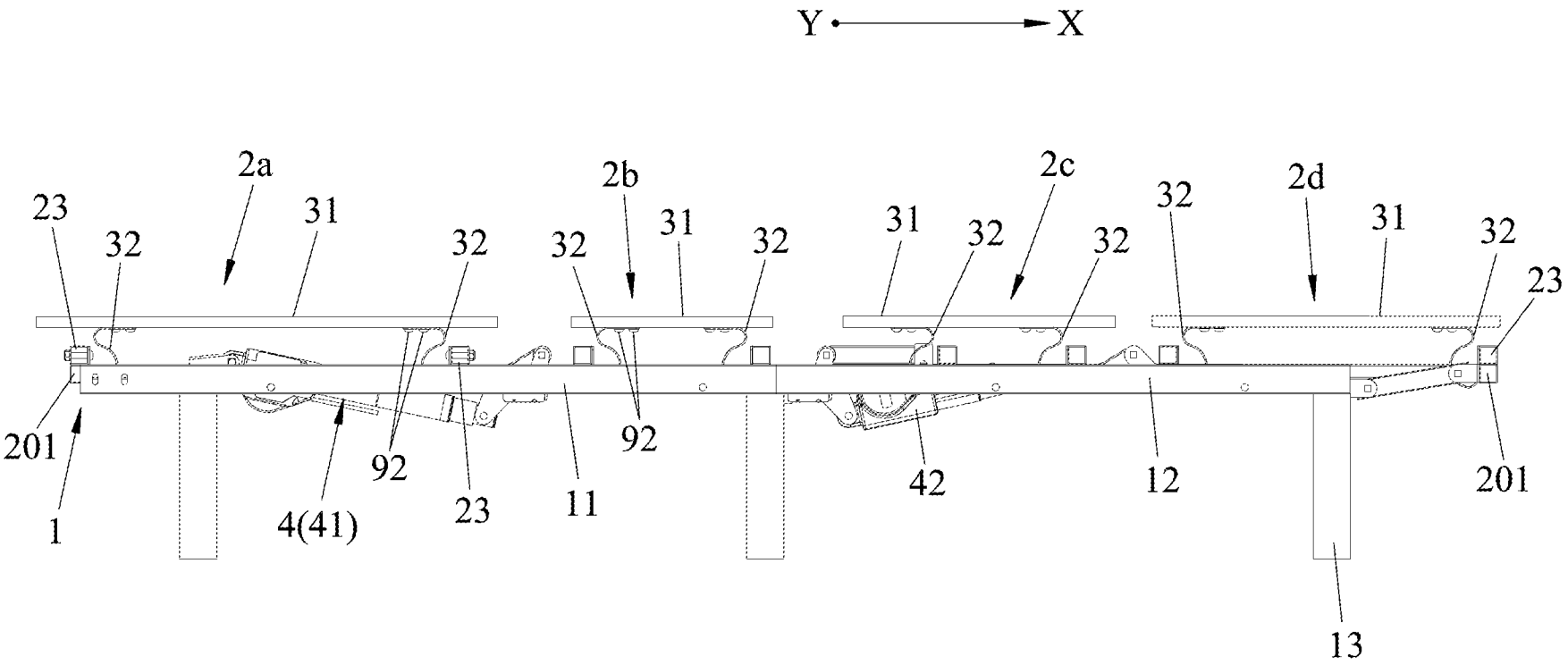
FIG. 2 is a side view of the modular bed of FIG. 1.

In an embodiment shown in FIGS. 1-3, the modular bed further includes a plurality of support legs 13 configured to elevate and place the base frame unit 1 in a stationary state.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A modular bed comprising a base frame unit, and a plurality of support frame units mounted on the base frame unit to be displaced from each other in a longitudinal direction, each of the support frame units including;

a leading bar and a trailing bar which are displaced from each other in the longitudinal direction, each of the leading and trailing bars having a left end segment and a right end segment opposite to the left end segment in a transverse direction relative to the longitudinal direction;

four mounting frames each extending upwardly from a respective one of the left and right end segments of the leading and trailing bars;

a support panel configured to conceal the mounting frames from view and disposed to be movable relative to the mounting frames between a loaded position and an unloaded position; and four bent leaf springs each having:

a secured segment having:

a first mounting region secured to a respective one of the mounting frames, and a suspended region extending lengthwise from the first mounting region to terminate at a lower juncture;

a fixed segment having;

a second mounting region fixed to a lower surface of the support panel; and an extension region extending lengthwise from the second mounting region to terminate at an upper juncture which is offset from the lower juncture by a predetermined length;

an upper curved segment which extends from the upper juncture in a circumferential direction to terminate at a deflection area; and a lower curved segment which extends from the lower juncture in a second circumferential direction to join the deflection area to permit the upper and lower curved segments to produce a combined biasing force so as to provide cushioning effect for the support panel in response to movement of the support panel from the unloaded position to the loaded position.

2. The modular bed according to claim 1, wherein the upper curved segment defines a radius of curvature smaller than the predetermined length.

3. The modular bed according to claim 2, wherein the lower curved segment defines a second radius of curvature larger than the predetermined length so as to increase the combined biasing force.

4. A modular bed comprising:

a base frame unit;

a plurality of support frame units mounted on the base frame unit to be displaced from each other in a longitudinal direction, at least one of the support frame units being pivotally mounted to the base frame unit, each of the support frame units including:

a leading bar and a trailing bar which are displaced from each other in the longitudinal direction, each of the leading and trailing bars having a left end segment and a right end segment opposite to the left end segment in a transverse direction relative to the longitudinal direction;

four mounting frames each extending upwardly from a respective one of the left and right end segments of the leading and trailing bars;

a support panel configured to conceal the mounting frames from view and disposed to be movable relative to the mounting frames between a loaded position and an unloaded position;

four spring members, each of which is configured to couple the support panel to a respective one of the mounting frames so as to provide cushioning effect for the support panel in response to movement of the support panel from the unloaded position to the loaded position; and a drive unit which is coupled between the base frame unit and the at least one of the support frame units so as to permit one of the leading and trailing bars of the at least one of the support frame units to be driven to move to an elevated position, where the one of the leading and trailing bars is remote from the ground, from a normal position, where the one of the leading and trailing bars is close to the ground.

* * * * *